US010286247B2

(12) United States Patent
Marquez

(10) Patent No.: US 10,286,247 B2
(45) Date of Patent: May 14, 2019

(54) PORTABLE STRENGTH TRAINING AND EXERCISE APPARATUS

(71) Applicant: Humberto Al Marquez, Fremont, CA (US)

(72) Inventor: Humberto Al Marquez, Fremont, CA (US)

( * ) Notice: Subject to any disclaimer, the term of this patent is extended or adjusted under 35 U.S.C. 154(b) by 267 days.

(21) Appl. No.: 15/390,673

(22) Filed: Dec. 26, 2016

(65) Prior Publication Data

US 2018/0178049 A1 Jun. 28, 2018

(51) Int. Cl.

| | |
|---|---|
| ***A63B 21/00*** | (2006.01) |
| ***A63B 21/04*** | (2006.01) |
| ***A63B 69/00*** | (2006.01) |
| ***A63B 71/00*** | (2006.01) |
| ***A63B 21/055*** | (2006.01) |
| ***A63B 23/035*** | (2006.01) |

(52) U.S. Cl.

CPC .... *A63B 21/0442* (2013.01); *A63B 21/00069* (2013.01); *A63B 21/0552* (2013.01); *A63B 21/0557* (2013.01); *A63B 21/4009* (2015.10); *A63B 21/4013* (2015.10); *A63B 21/4015* (2015.10); *A63B 21/4025* (2015.10); *A63B 21/4035* (2015.10); *A63B 21/4039* (2015.10); *A63B 23/0355* (2013.01); *A63B 23/03508* (2013.01); *A63B 23/03541* (2013.01); *A63B 23/03575* (2013.01); *A63B 69/0086* (2013.01); *A63B 71/0054* (2013.01); *A63B 21/00061* (2013.01); *A63B 2209/00* (2013.01); *A63B 2209/10* (2013.01); *A63B 2225/09* (2013.01)

(58) Field of Classification Search

CPC . A63B 21/00069; A63B 21/026; A63B 21/04; A63B 21/0442; A63B 21/0555; A63B 21/0557; A63B 21/4009; A63B 21/4013; A63B 21/4034; A63B 21/4035; A63B 21/4039; A63B 21/4043; A63B 23/03575; A63B 23/04; A63B 23/12; A63B 71/0054; A63B 2069/0006; A63B 2209/00; A63B 2209/10; A63B 2225/09

See application file for complete search history.

(56) References Cited

U.S. PATENT DOCUMENTS 1,506,631 A * 8/1924 Grover ..... A63B 21/0004 482/124

3,729,195 A * 4/1973 Hutt ..... A63B 43/007 473/575

(Continued)

*Primary Examiner* — Joshua Lee

(57) ABSTRACT

A portable strength training and exercise apparatus constitutes an attachment belt to be worn by an individual about the waist. The attachment belt has attachments on center and side portions of the belt for attaching locking strap holders, used for attaching adjustment straps, which in turn, attach to resistance elastic tubes. Hollow balls are attached to ends of the resistance elastic tubes. For an upper extremities exercise, hollow balls are grasped in each hand and are moved by both arms in almost any direction or angle an individual can manage against the resistance of the resistance elastic tubes. For a lower extremities exercise, hollow balls are connected to the individual's feet using foot straps and are moved by both legs in almost any direction or angle an individual can manage against the resistance of the resistance elastic tubes.

11 Claims, 13 Drawing Sheets

(56) References Cited

U.S. PATENT DOCUMENTS

| | | | | | |
|---|---|---|---|---|---|
| 3,738,654 | A * | 6/1973 | Whaley, Jr. | A63B 21/0552 | 128/99.1 |
| 4,021,035 | A * | 5/1977 | O'Hara | A63B 69/0086 | 273/DIG. 19 |
| 4,121,822 | A * | 10/1978 | DiSabatino | A63B 69/0086 | 2/310 |
| 5,244,206 | A * | 9/1993 | Clark | A63B 69/0086 | 273/118 R |
| 5,885,175 | A * | 3/1999 | Marquez | A63B 21/0004 | 473/464 |
| 5,976,041 | A * | 11/1999 | Banker, Sr. | A63B 43/007 | 473/424 |
| 7,976,414 | B2 * | 7/2011 | McKay | A63B 69/0002 | 473/458 |
| 9,266,001 | B1 * | 2/2016 | Leon | A63B 69/0002 | |
| 2009/0075763 | A1 * | 3/2009 | Wu | A63B 69/0086 | 473/424 |
| 2009/0082183 | A1 * | 3/2009 | Haynes | A63B 21/0552 | 482/124 |
| 2010/0120591 | A1 * | 5/2010 | Shaterian | A61H 15/0092 | 482/106 |
| 2014/0342882 | A1 * | 11/2014 | Huang | A63B 21/22 | 482/110 |
| 2015/0251040 | A1 * | 9/2015 | Pinder | A63B 21/0407 | 482/124 |
| 2016/0199717 | A1 * | 7/2016 | Holland | A63B 69/0079 | 473/423 |

* cited by examiner

PORTABLE STRENGTH TRAINING AND EXERCISE APPARATUS

FIELD OF THE DISCLOSURE

This invention relates broadly to a portable strength training and exercise apparatus used for exercising the upper and lower body and particularly for a portable strength training and exercise apparatus that is lightweight, portable and simple to use. The disclosed apparatus facilitates improving arm and leg strength, the speed and power of athletes and the toning of the body muscles of individuals by using resistance training. The disclosed portable strength training and exercise apparatus strengthens and targets upper and lower body muscles with resistance tubing, by exercising with selective adjustable tension to exercise various body muscles.

The disclosed portable strength training and exercise apparatus invention uses exercise methods that are new and revolutionary. Normally, traditional exercise equipment requires special benches or equipment to execute. The disclosed portable strength training and exercise apparatus is portable and lightweight, weighing less then a pound which makes the disclosed portable strength training and exercise apparatus desirable for individuals to exercise at home or while traveling by using resistance training.

The disclosed portable strength training and exercise apparatus can also be used to warm up before a sporting event, thereby preventing injuries. Selectable resistance tension methods are used which allows for anyone of any age and any strength capability to benefit from using the disclosed portable strength training and exercise apparatus.

BACKGROUND OF THE INVENTION

In modern times, many resistance bands have been used with or without equipment for many years for strengthening and exercising body muscles. Unfortunately, the currently available band-based exercise equipment is bulky, heavy and expensive. The size, weight and cost of such exercise systems keep many people from taking advantage of the many benefits afforded to people who get regular exercise. The disclosed portable strength training and exercise apparatus will attract new users who normally could not find time to exercise at a gym or who just want to exercise at their own convenient place or time.

With the disclosed portable strength training and exercise apparatus individuals can create their own exercise routines or follow existing exercise routines for a particular sport. The disclosed portable strength training and exercise apparatus will increase the exercise habits of users because of the portability, lightweight and ease of use characteristics. The disclosed portable strength training and exercise apparatus is sturdy in its construction, inexpensive to manufacture and easy to use effectively for many intended exercises. Compared to a gym membership or private equipment cost, the disclosed portable strength training and exercise apparatus is handy to use. In addition, the disclosed portable strength training and exercise apparatus does not need a door or some other fixture to hold it in place, like other commercially available resistance devices.

One of the important objects of the invention is to facilitate simple, targeted exercises in a relaxed environment, either at home on a chair or a couch, at the office, a park bench, etc. The invention is durable and lightweight and can be used in a gym, group workout, indoors or outdoors, to enable and develop the muscles of the body and for the prevention of injures.

The invention possesses other objects and features of advantage, some of which, along with the foregoing description, will be apparent from the following description and the drawings. It is to be understood however that the invention is not limited to the embodiment illustrated and described since it may be embodied in various forms within the scope of the appended claims.

SUMMARY OF THE INVENTION

The disclosed portable strength training and exercise apparatus invention includes the techniques and methods for fabricating a standard resistance elastic tube attached to a hollow ball on one end of the resistance tube. The disclosed portable strength training and exercise apparatus invention includes the techniques and methods for fabricating a standard resistance elastic tube in a manner that allows an adjustment strap on the other end by converting the resistance elastic tube into a flat hardened mounting attachment with a hole with which to fasten an adjustment strap. The disclosed assembly drawings will explain the methods and techniques of construction in detail, including safeguards to prevent end portions of the elastic tube from breaking free of the hollow ball end and also from breaking or tearing at other points.

Currently, there are many exercise systems based on elastic tube bands on the market that have standard connecting end plugs to attachment handles or holders. These often break at the point of attachment. Some have common problems, such as slipping and unwanted detachment. In addition, selecting a common band for a target exercise area is not easy as there are so many types of bands to choose from, including kits with almost every type of band included. Most are not convenient or handy to use. Currently, many models come with a standard handle and are held down in place with the assistance of doors or some other type of object. Current applications use bands that are meant to be wrapped around the body, stretched arm to arm, feet to arm, etc. They are somewhat effective but they are not easy to use. The problems include slipping out of the user's hands or feet caused by not holding or mounting bands properly. These are just a few typical issues we all have encountered while trying to exercise with bands.

No invention has incorporated the use of a baseball size, hollow ball end for hands and feet, with attachments easily attached to an attachment belt using resistance elastic tubes with interchangeable elastic tensions of tubing, from very light to very strong, making portable strength training and exercise apparatus all-inclusive invention, easy to manipulate for individuals to exercise the entire body simultaneously targeted body areas.

The portable strength training and exercise apparatus uses a hollow baseball size ball end, hollow ball end, invention apparatus uses terminology ball end similar to names use in industry, truck ball end, ball end joint, trailer ball end hitch, countless ball end names, except instead of metal, apparatus uses elastic tube connected to a round plastic ball end.

Apparatus uses a hollow ball end with resistance elastic tube and adjustment strap, connected to a belt, attachment belt with three locking strap holders, located on right, center and left side of belt, the attachment belt, connected to quick release standard quick disconnect buckle, sewn onto a nylon webbing belt with extra length beyond attachment belt to encircle the body about the waist looping through mating locking male connecting buckle for appropriate abdomens, adjustable for different sizes and ranges of waist.

Apparatus invention uses an attachment belt, for holding exercise devises and is the pivoting central point for upper and lower extremities; individual grasp in hand two hollow ball end and also secured to both feet two hollow ball end, the wearer now is in position to start a full body exercise workout. During exercising attachment belt receives the force created by individuals pushing and pulling resistance elastic tube, acceleration with magnitude and direction directly proportional to the net force created by individuals transferring from upper and lower limbs onto attachment belt.

Resistance training has been used for many years and resistance training exercises have been largely published and advertised. This invention uses resistance elastic tube, portable, small, light and versatile and can be used in many places including gym, office, traveling, outdoors, indoors at home on floor, chair, couch, bed, plus countless options, meaning anywhere and anytime.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

DETAILED DESCRIPTION

A portable strength training and exercise apparatus is described. In the following description, numerous specific details are set forth. However, it is understood that embodiments may be practiced without these specific details. In other instances, well-known materials, structures, and techniques have not been shown in detail in order not to obscure the understanding of this description.

The terms, "for example," "e.g.," "in one/another aspect," "in one/another scenario," "in one/another version," "in some configurations," "in some implementations," "preferably," "usually," "typically," "may," and "optionally," as used herein, are intended to be used to introduce non-limiting embodiments. Unless expressly stated otherwise, while certain references are made to certain example system components or services, other components and services may be used as well and/or the example components may be combined into fewer components and/or divided into further components.

Figure 1:
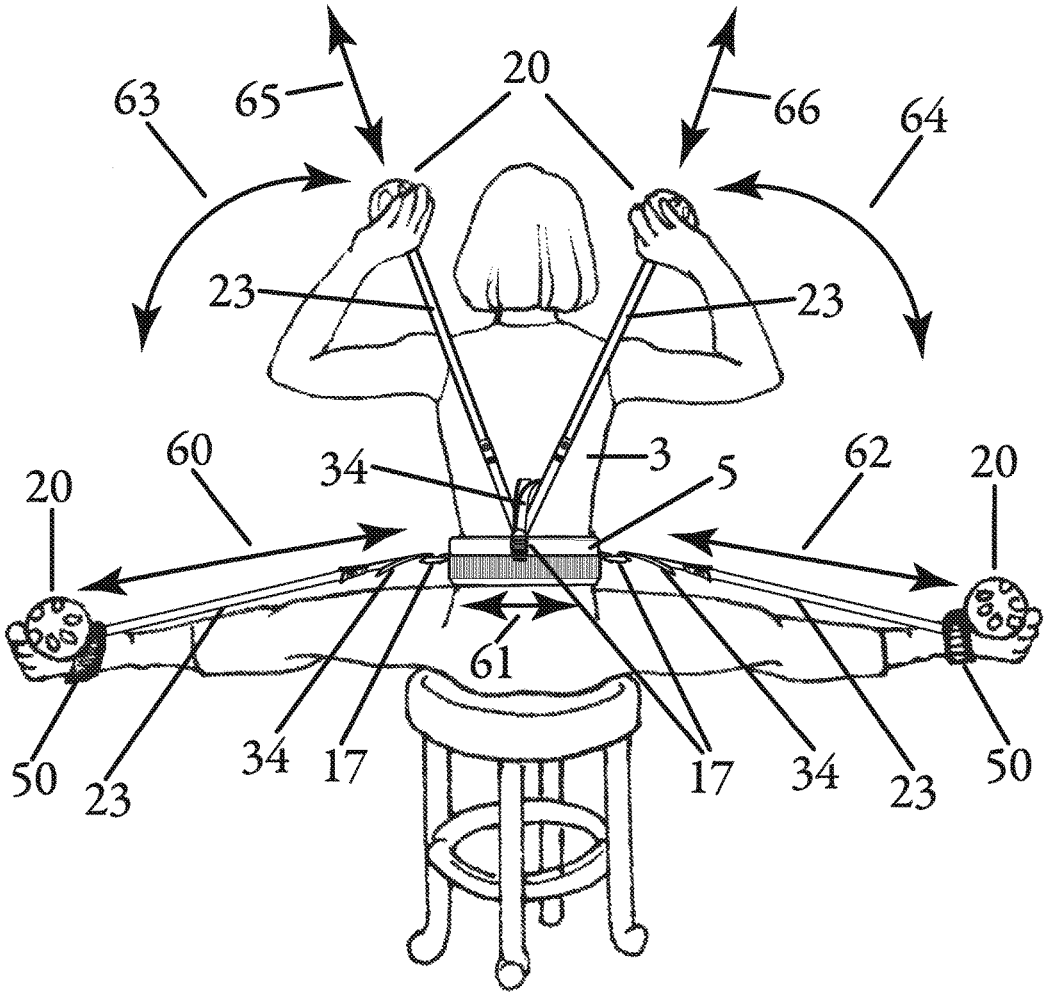
FIG. 1 is a perspective back view illustrating the apparatus forming the subject matter of the invention worn by an individual, mounting apparatus at waist and showing versatile of apparatus the method of exerting muscular force on upper and lower limps to stretch the resistance elastic tube using stomach and back muscles due to exertion of attachment belt exercising arms and feet, grasping with hands hollow ball end and fasten to feet with foot strap, exerting muscular force on upper and lower limps. It should be noted that apparatus can be preformed standing or sitting as shown on illustration.

Turning now to the FIG. 1 drawing, which is included by way of example and not limitation, the present disclosure is directed towards a back view of a person 3, one component of the apparatus is a belt designated generally by attachment belt 5 adapted to be worn about the waist of a person 3 for the purpose of attaching other components shows resistance elastic tube 23, locking strap holder 17, adjustment strap 34 and hollow ball end 20 of the apparatus, for manipulability exercising method of exerting muscular force on upper and lower area designated generally by the numerals 60, 62, 63, 64, 65, 66 including back 61, to develop and strengthen the muscles for exercising selectively areas of hand, forearm, shoulder and about the waistline, the upper, biceps, shoulder area, and trapezius. Muscles exercising lower limbs include foot, ankle, knee, calf and upper leg, hamstrings, quadriceps, quads, biceps femoris and calves.

Illustration also shows a foot strap, adapted to be worn about the foot of a person 3 foot strap 50 is used to security foot to hollow ball end 20 and resistance elastic tube 23, for exerting muscular movements on both legs freely and safely, illustration shows person 3 exercising simultaneously the entire body, lower and upper extremity, apparatus mobility, wide range of motion and angles usage makes apparatus desirable for fitness, sports, recreation, rehab and therapy.

Figure 2:
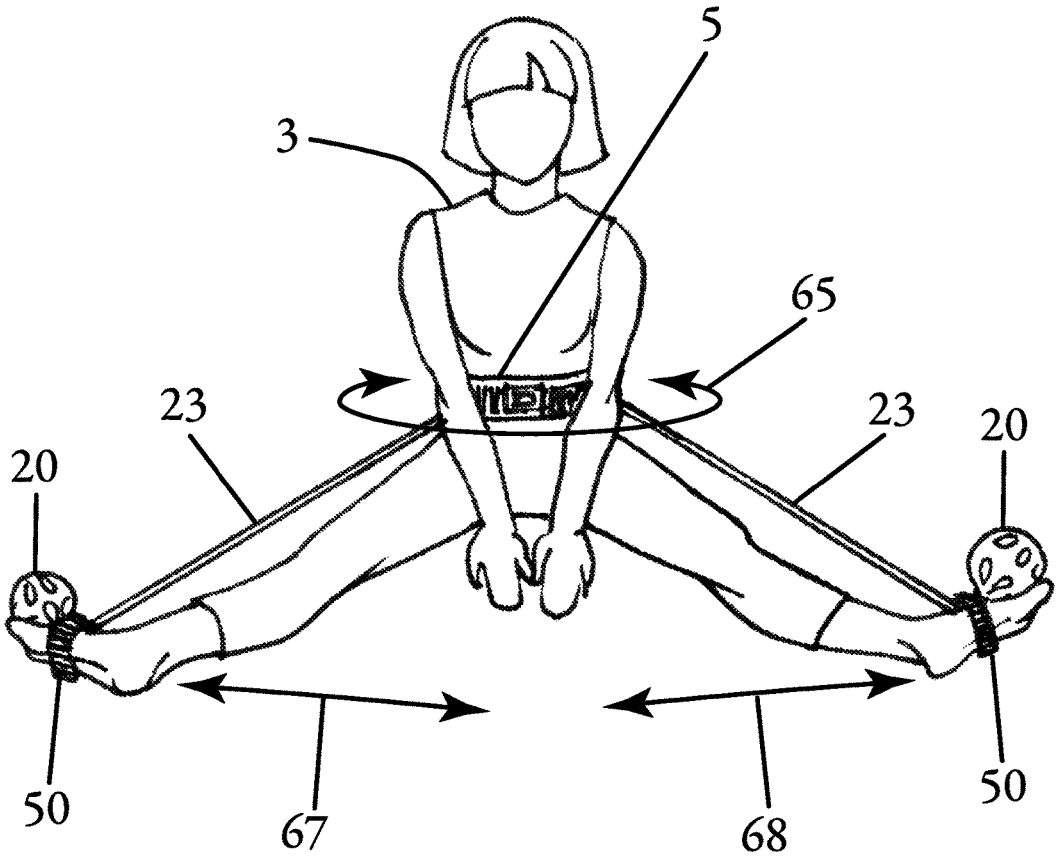
FIG. 2 is a perspective front view illustrating the apparatus forming the subject matter of the invention worn by an individual, mounting apparatus at waist and showing versatile of apparatus focusing on lower limps, the method of exerting muscular force to stretch the resistance elastic tube from stomach muscles to feet.

FIG. 2 illustration shows front view, a belt designated generally by attachment belt 5, adapted to be worn about the waist of a person numeral 3 and manipulability exercising method of exerting muscular force on lower area designated generally by the numeral 67 and 68, including stomach muscles 65, exercising lower body including leg, calf, ankle, upper leg, knee, lower leg, ankle, and foot including hamstrings and quadriceps, quads, biceps femoris and calves; illustration shows foot strap 50 adapted to be worn by person numeral 3 on top of, foot strap 50 is used to security foot to hollow ball end 20 and resistance elastic tube 23, illustration shows a person numeral 3 exerting muscular movements on both legs freely and safely, apparatus mobility, wide range of motion and angles usage makes apparatus desirable for fitness, sports, recreation rehab and therapy.

Figure 3:
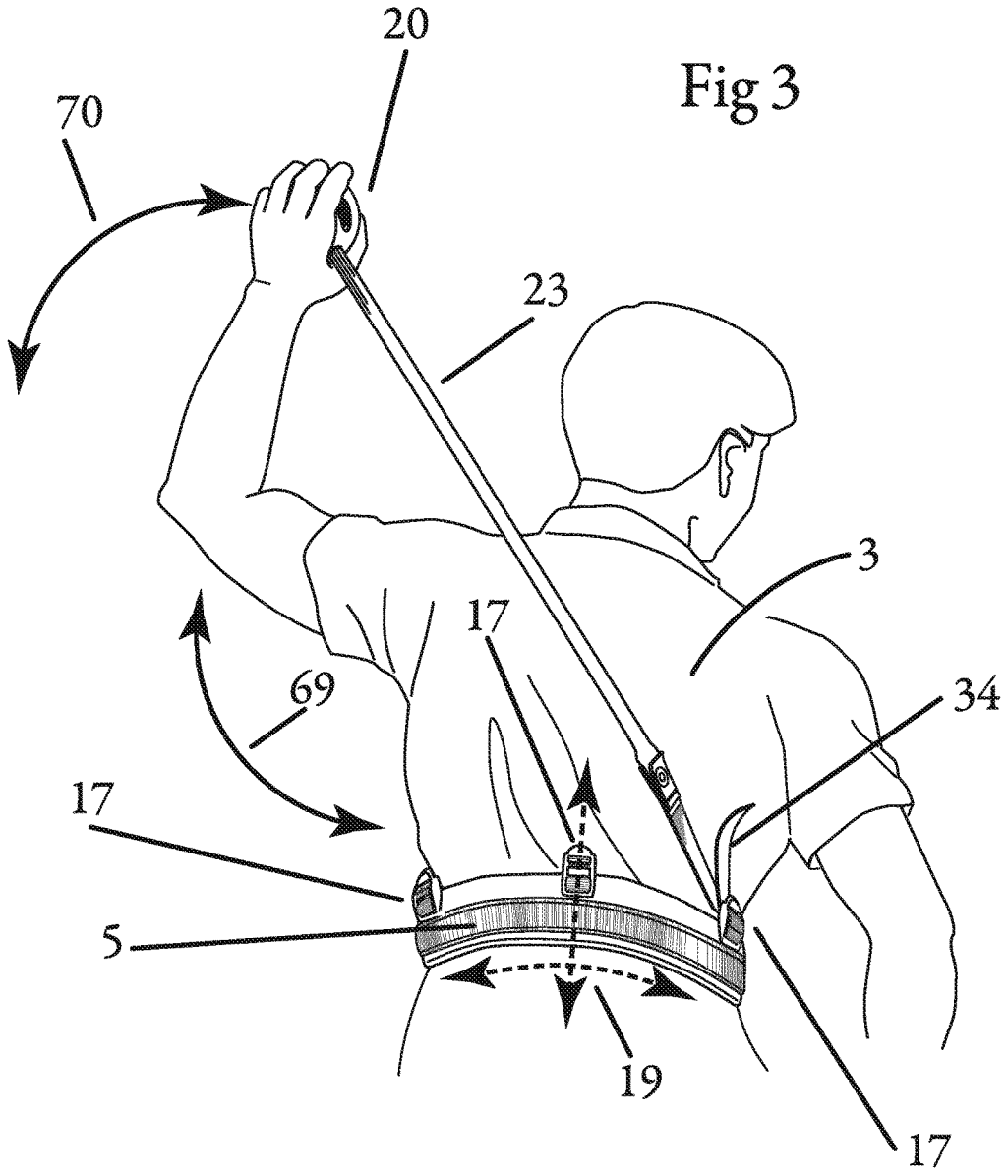
FIG. 3 is a perspective back view illustrating the apparatus forming the subject matter of the invention worn by an individual, mounting apparatus at waist and showing versatile of apparatus including optional shifting belt around waist for more or less resistance or up for additional workouts. Rotating belt completely around 360 degrees adds additional easy and handy frontal holding of hollow ball ends. Exercise focusing on upper body, the method of exerting muscular force to stretch from attachment belt to the resistance elastic tube to shoulders muscles arms and hands, with option to connect additional attachments of resistance elastic tubes.

FIG. 3 illustration shows a perspective view of back of a person, a belt designated by attachment belt 5, and adapted to be worn about the waist of a person numeral 3, manipulability, exercising method of exerting muscular force on upper area designated generally by the numeral 69 and 70, with exercising option of either hand or both simultaneously. Illustration shows handy and simple technique to manipulate tension for increase or decrease resistant of resistance elastic tube 23, by maneuvering to desirable tension with adjustment strap 34 and locking strap in place with locking strap holder 17.

Referring to attachment belt 5, on FIG. 3, <---> swiveling belt horizontal numeral 19 to left or right in small increments increases or decreases tension to resistance elastic tube 23, for tension resistance needed to targeted body area.

Referring to attachment belt 5, on FIG. 3, <---> rotating attachment belt 5 horizontal numeral 19 360 degrees adds additional easy and handy frontal holding of hollow ball ends 20 to exercise with resistance elastic tube 23 exercising shoulders muscles arms and hands, exercise focusing on upper body, the method of exerting frontal muscular force to stretch from waist to upper shoulder.

Referring to attachment belt 5, on FIG. 3, <---> moving attachment belt 5, vertically numeral 19 up or down to a different height position, gives individuals additional target body areas a method of exerting muscular force on upper body, strengthening muscles by exercising selective area with selective resistance tension.

Apparatus portability and wide range of angles, attractive and relevant makes apparatus desirable for sports, recreation, fitness, rehab and therapy. Let it be noted that illustration FIG. 3, shows one, locking strap holder 17, being used and can add two more or as needed for additional simultaneous exercising.

Figure 4:
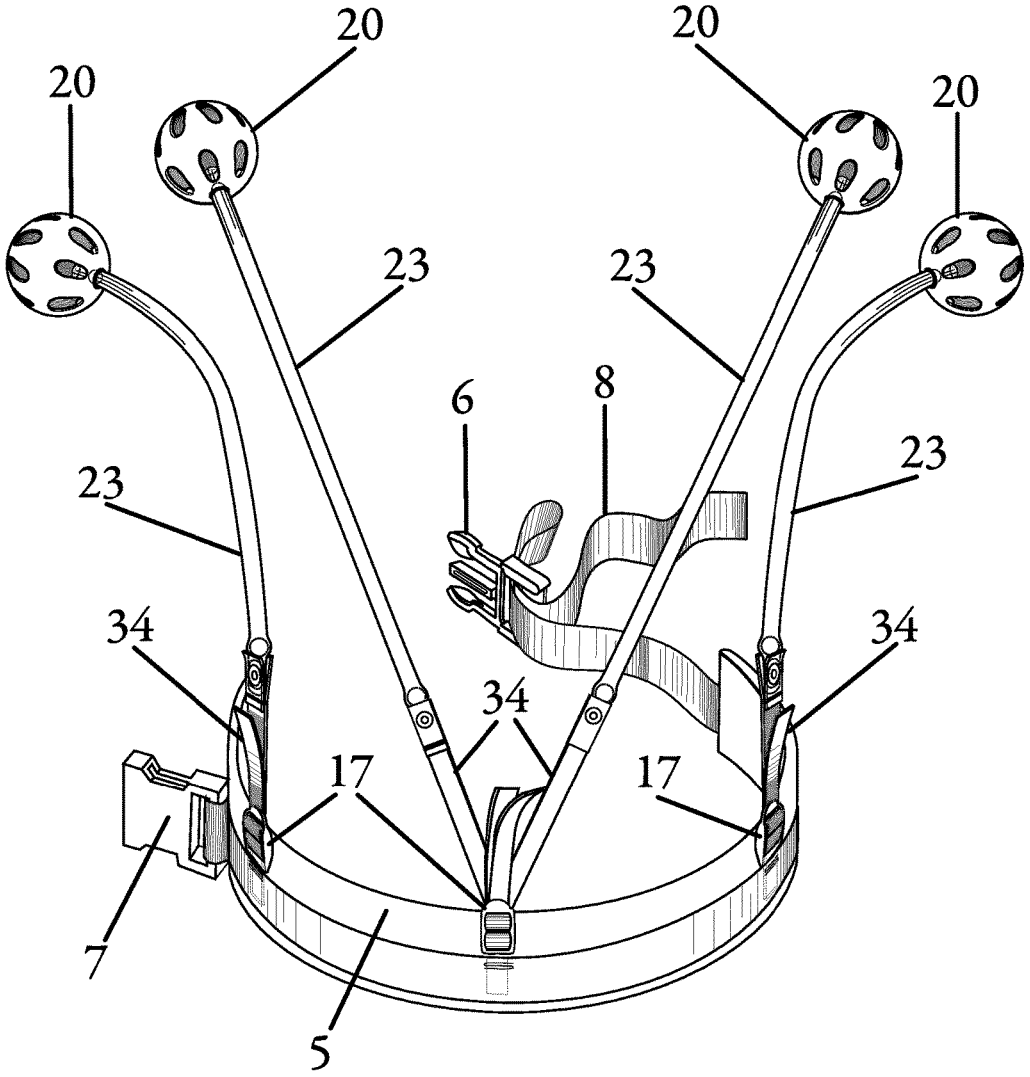
FIG. 4 is a perspective view illustrating the apparatus, showing four hollow ball ends for hands and feet, illustrating attachment belt and fixed attachments, locking strap holders with the associated end portion of adjustment straps, connected to resistance elastic tube and four hollow ball ends.

FIG. 4 illustration shows a complete assembled portable strength training and exercise apparatus attachment belt 5 with attachments connected, female quick disconnect buckle 7 mating with male connecting buckle 6, webbing belt 8 with additional length for adjustment of different waist sizes, sewn is three spaced apart locking strap holder 17 to lock and hold four, adjustment straps 34 loosing and adjusting strap up or down by hand increases or decreases elastic resistance tension of four, resistance elastic tube 23 exercised by extending and stretching and returning in a repetitive motion, four hollow ball end 20 two grasped with right and left hand, two strapped and secured comfortably to both feet, note; person and foot strap not shown on FIG. 4 illustration.

Figure 5:
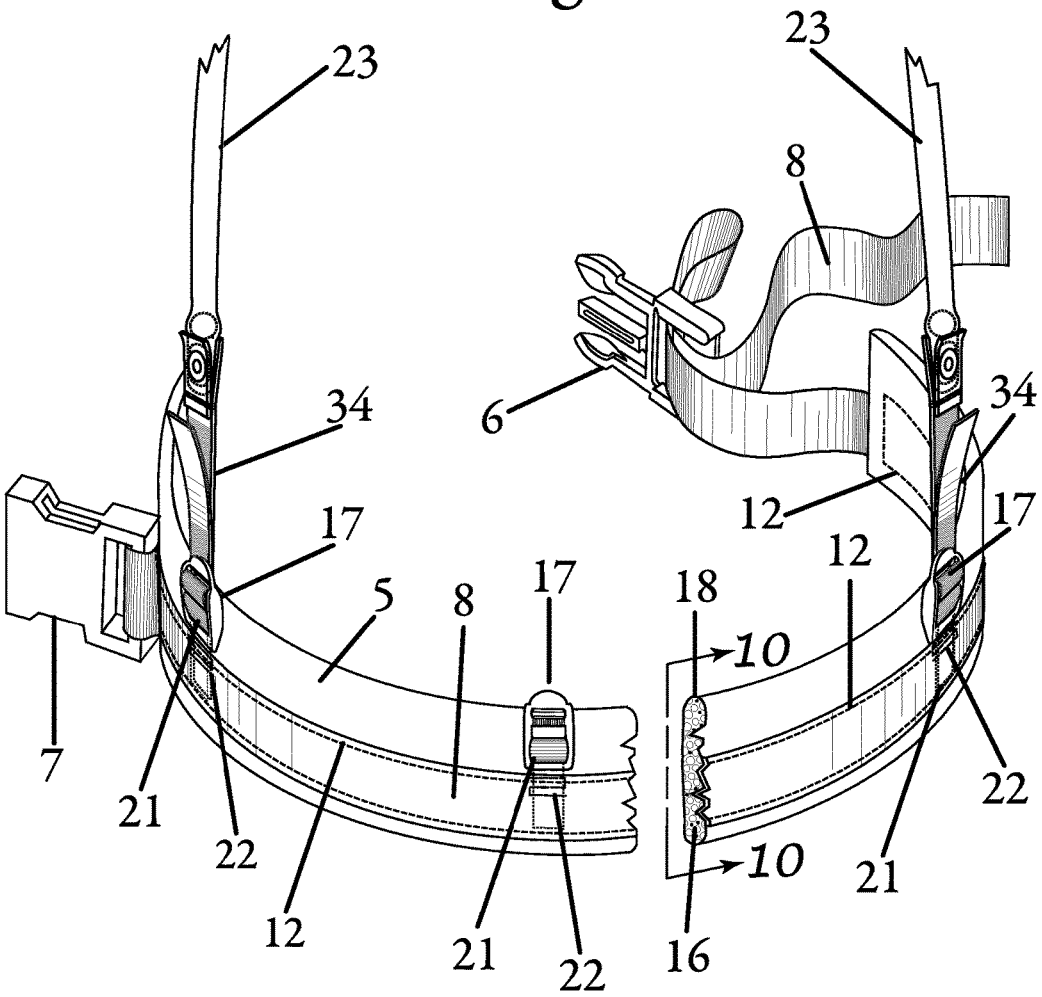
FIG. 5 is a perspective view illustrating the apparatus, showing belt and buckles attachment with extra webbing belt for different sizes and ranges of people and the associated end portion adjustment straps connected to resistance elastic tube and portions of the belt structure being broken away to reveal stitching and underlying structure. Showing the manner of enlarged portions detailed on another illustration.

FIG. 5 webbing belt 8 is material known as webbing for strength and non-elasticity, but may be formed from any other suitable material that possesses like characteristics, webbing is made of synthetic fibers such as nylon, polypropylene or polyester, the webbing continues from female quick disconnect buckle 7, stitched with stitching 12 on main mounting attachment belt 5, loop through, male connecting buckle 6, with extra webbing length for adjustability sizes to fit different waistlines of individuals, accomplished by adjustment of the male connecting buckle 6 and webbing belt 8.

In relation to the main mounting belt, attachment belt 5 internally encased is a thick appropriate cushioning, material such as closed-cell polyurethane, foam sheet 16, the main mounting attachment belt 5 is wrapped with suitable, flexible material 18, that possesses like characteristics including nylon blends, Sewn to male connecting, female quick disconnect buckle 7 sewn around and completely through inner surfaces of polyurethane foam sheet and webbing belt 8, fasten together with, stitching 12 sewn together at opposite ends with heavy nylon tread generally medially of the transverse dimension of webbing belt 8.

Fastened to the attachment belt 5 on webbing belt 8 is three locking strap holder 17 position at intervals on left, center and right, attached with mounting loop 21 webbing, material similar to webbing belt 8, attached together and sewn with, stitched 22 at opposite ends.

Figure 10:
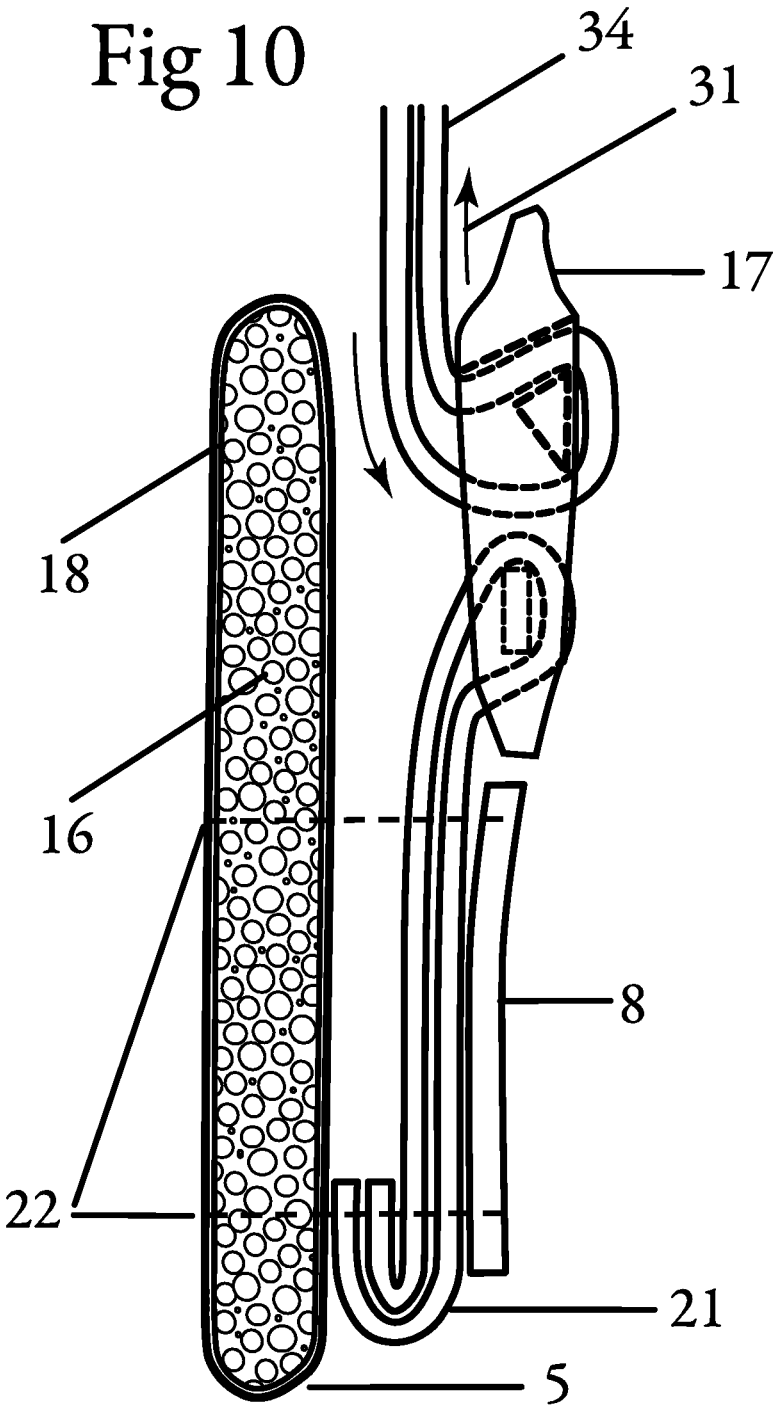
FIG. 10 is an enlarged perspective view of a portion of FIG. 5, portions of the structure being broken away to reveal underlying structure and illustrating method of attachment of the attachment belt to the fixed attachment loop with locking strap holder and adjustable end portion of adjustment straps.

Referring to FIG. 5 indicated by the arrow line 10-10, illustrating an enlarged perspective view of the portion shown on FIG. 10 a different method of attachment, illustrating end view of attachment belt 5 stitched 22, mounting loop 21, webbing belt 8, locking strap holder 17 with adjustment strap 34 and resistance elastic tube 23.

Figure 6:
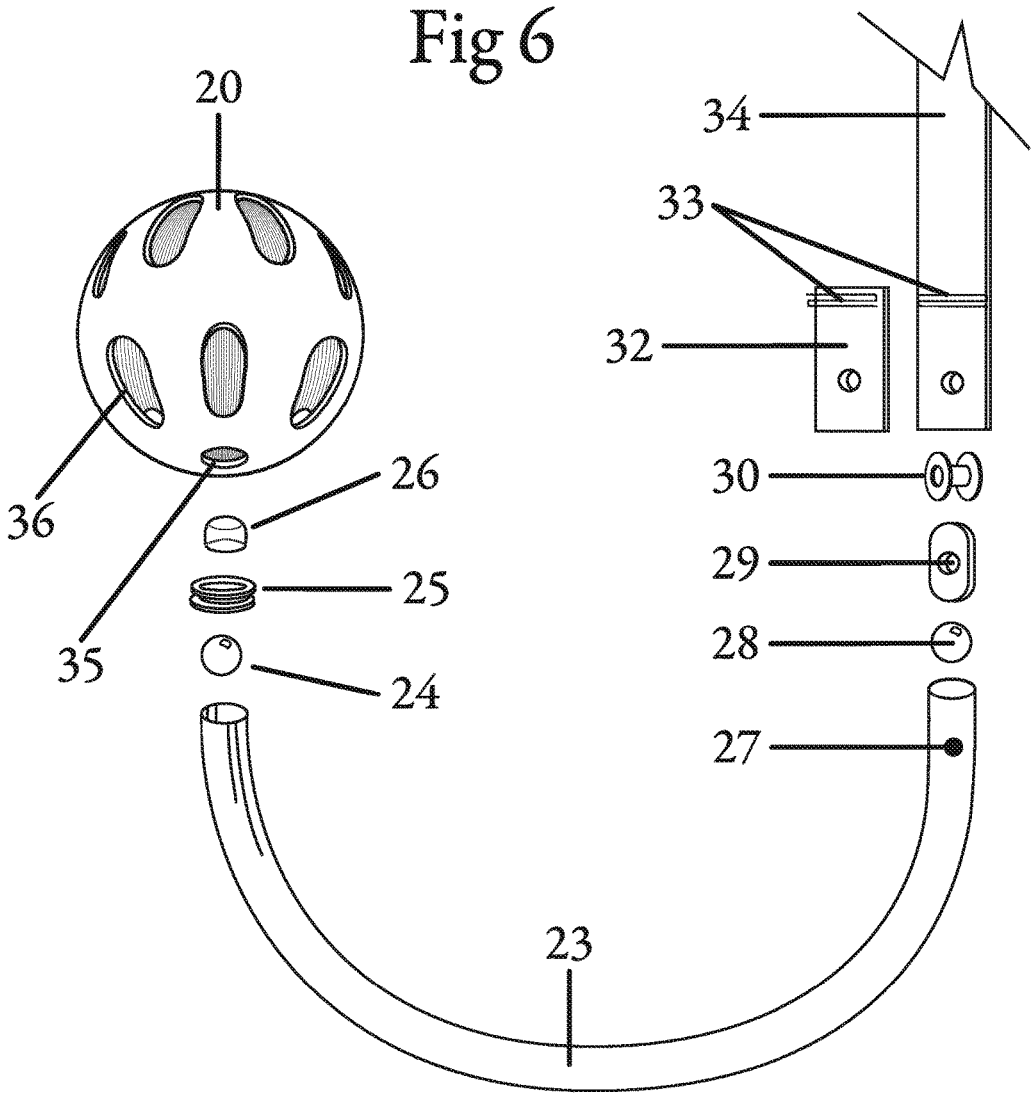
FIG. 6 is a perspective view illustrating the invention and construction of the device being broken away to illustrate the manner of order of attachment and revealing each individual part associated with apparatus, portions being broken away to reveal underlying formation of the structure.

FIG. 6 in terms of greater detail illustration shows portable strength training and exercise apparatus invention being broken away to illustrate the manner of order of attachment and revealing each individual part associated with apparatus portions reveal underlying formation of the structure.

Illustration assemble shows a hollow ball end 20, with a series of sixteen oblong holes 36 around hollow ball end 20 traditional a base ball training ball, except apparatus hollow ball end 20 is used for grasping and holding on hands and feet, using vent holes 36 to insure a firm holding grip on hands.

Hollow ball end 20, material is plastic consisting of any synthetic or semi-synthetic organic compounds that is malleable and can be molded into solids or any alloys, hollow ball end 20 is large enough for individual or persons to hold in either hand, similar size as a standard baseball. One circular through-hole on bottom, ball thru-hole 35, allows resistance elastic tube 23 material, natural rubber latex tubing or same characteristics, to pass through inside of hollow ball end 20.

It should be noted; resistance elastic tube 23 can be interchange from very light resistance elastic tubing to very strong resistance elastic tension tubing.

Internally fitting inside of elastic tube is small end stop solid ball 24, material; poly methyl methacrylate, also known as acrylic a transparent thermoplastic acrylic resin or any alloys or same characteristics, used to mechanically stop and insurance the resistance elastic tube 23 from breaking out of ball thru-hole 35.

A grommet 25, material: rubber, synthetic or same characteristics, mounts on ball thru-hole 35 of hollow ball end 20 with resistance elastic tube 23 going through inside of grommet 25.

Grommet 25 is used for generate countless angles with no fiction or wear to damage or breakage to resistance elastic tube 23 and is insurance number two, to mechanically stop the solid ball 24 from breaking out of ball thru-hole 35.

Adhesive dam 26, locks all internally parts in resistance elastic tube 23, and is insurance number three to mechanically stop solid ball 24 and adhesive dam 26 from coming out or breaking out of resistance elastic tube 23.

Figure 7:
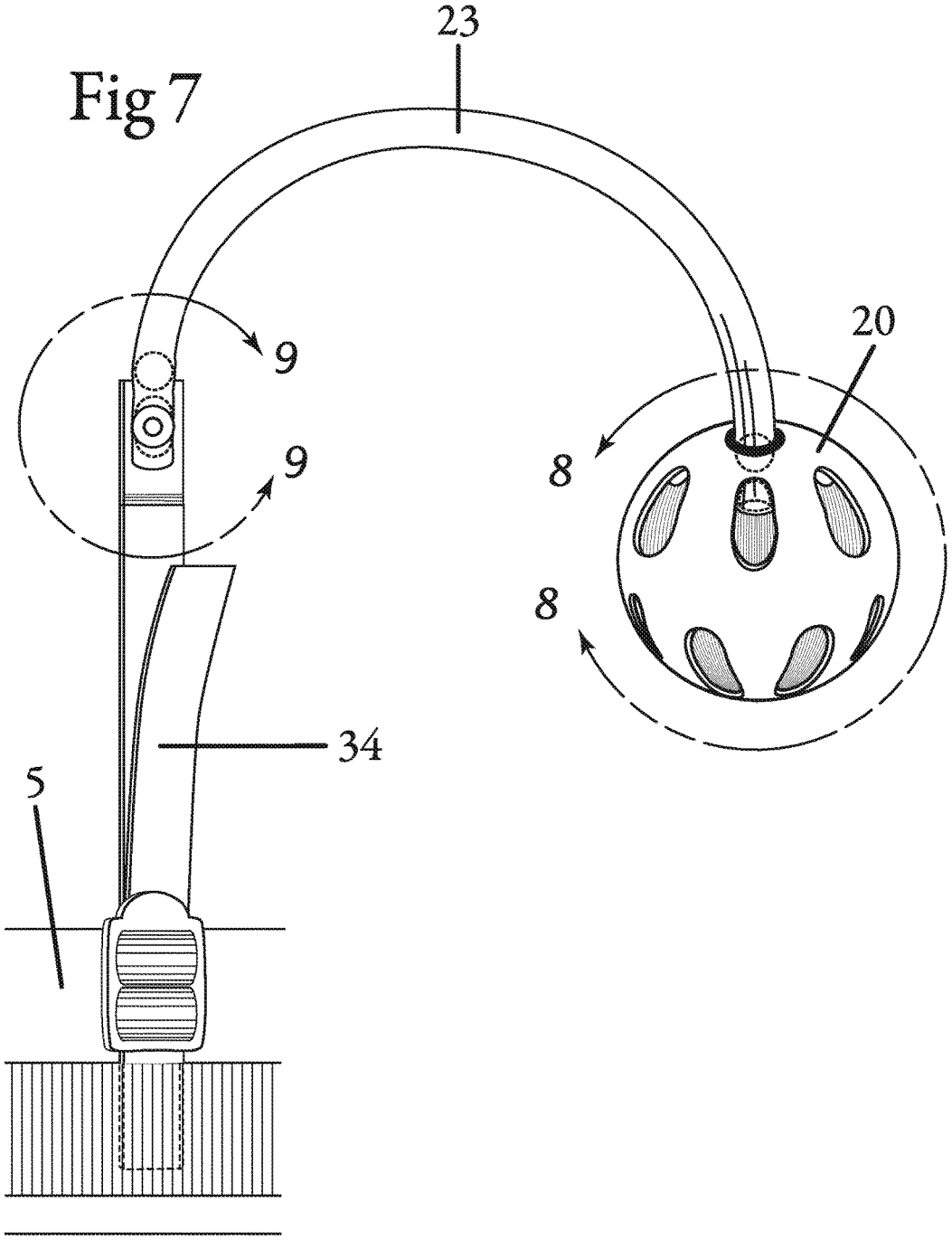
FIG. 7 is a perspective view illustrating invention fabrication of device in sequence, illustrates the manner of order of attachment, a portion totally assembled to reveal entire structure. Showing the manner of enlarged portions detailed on another illustrations.
Figure 8:
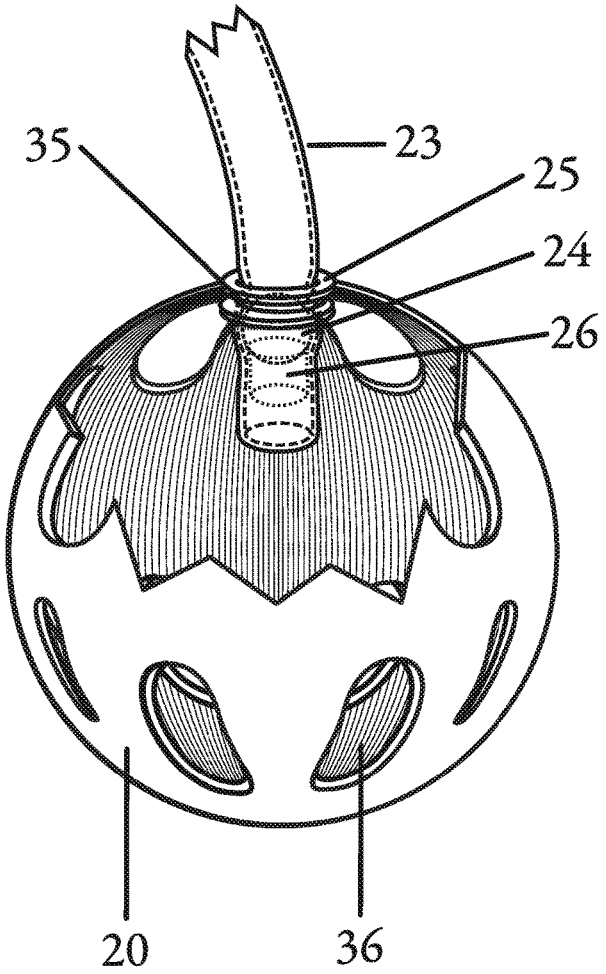
FIG. 8 is an enlarged perspective view of a portion of FIG. 7, a portion of the structure being broken away to reveal underlying structure and illustrating method of attachment of the end portion of resistance elastic tube to the connecting portion of the hollow ball end.

FIG. 7, 8 . . . 8 assemble is described in FIG. 8

On the opposite side of hollow ball end 20 on resistance elastic tube 23 a through-hole 27, also refers as thru-hole that is reamed, drilled, milled, melted, completely through the material.

Inserted and place inside resistance elastic tube 23 is mounting felt washer 29, a textile, produced by matting, condensing and pressing fibres, also internally inside resistance elastic tube 23, is small strap solid ball 28, material similar to the material from solid ball 24.

Illustration shows adjustment strap 34 mating with end strap 32, both a web type material, commonly known as webbing, is known for strength and non-elasticity, but may be formed from any other suitable material that possesses like characteristic; webbing is made of synthetic fibers such as nylon, polypropylene or polyester, both numeral 34 and 32 is sewn together, stitched 33 at opposite ends with heavy nylon tread generally medially of the transverse dimension of webbing, joining all parts together is male and female rivet 30 or any binder type fastener.

Figure 9:
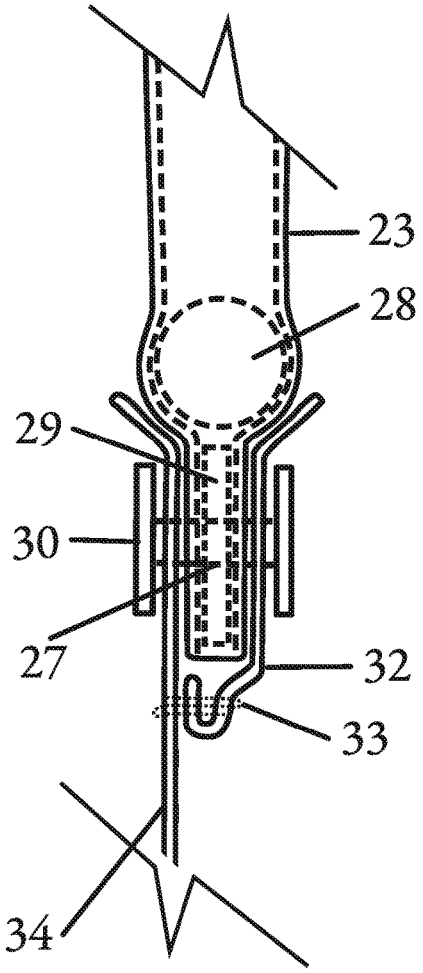
FIG. 9 is an enlarged perspective view of the portion of FIG. 7, a portion of the structure being broken away to reveal underlying structure and illustrating method of attachment of the end portion of adjustment strap to the end portion of resistance elastic tube.

An enlarged perspective view of the portion on FIG. 7, 9 . . . 9, assemble described in greater detail on FIG. 9

FIG. 7 in this embodiment a collective is shown in sequence attachment belt 5, adjustment strap 34, resistance elastic tube 23 and hollow ball end 20.

Referring to FIG. 7 is an enlarged perspective view of the portion of FIG. 8 indicated by the 8-8 arrow line and illustrating a different method of attachment of the hollow ball end 20 and resistance elastic tube 23.

Referring to FIG. 7 is an enlarged perspective view of the portion of FIG. 9 indicated by the arrow line 9-9 and illustrating a different method of attachment of the resistance elastic tube 23 and adjustment strap 34.

FIG. 8 invention embodiment a collective view referred from FIG. 7 is shown in sequence an enlarged elevational view of the structure associated end portion of the hollow ball end 20, with oblong holes 36 being broken away to illustrate the manner of attachment of the associated end portion of the resistance elastic tube 23.

A ball thru-hole 35 easier seen on FIG. 6 shown on top of hollow end ball 20 allows resistance elastic tube 23 to pass through; internally, inside tube is small end stop, solid ball 24 used to mechanically stop and insurance the resistance elastic tube 23 from breaking out of ball thru-hole 35.

Grommet 25 mounts on wall of ball thru-hole 35 of hollow ball end 20 resistance elastic tube 23 passes through center of grommet 25 and ending inside of ball end. This embodiment of invention is used for generate different angles with no fiction or wear, insuring no damage or breakage to resistance elastic tube 23 and is a secondary insurance to mechanically stop the solid ball 24 from breaking out of ball thru-hole 35.

Adhesive dam 26, locks all internal parts inside resistance elastic tube 23 and is insurance number three to mechanically stop solid ball 24 and adhesive dam 26 from coming out or breaking out of resistance elastic tube 23. Assemble is tested rigorist using dynamic tension force.

FIG. 9 invention embodiment a collective view referred from FIG. 7 is shown in sequence enlarged elevational view of the structure a portion broken away to illustrate the manner of attachment, located on end of resistance elastic tube 23 is a through-hole 27 refers, as thru-hole that is reamed, drilled, milled, melted, completely through the tube material.

Inserted and placed inside end of resistance elastic tube 23 is strap solid ball 28 used to generate countless angles with no fiction or wear to damage or breakage resistance elastic tube 23 also inserted and placed inside of resistance elastic tube 23 is mounting felt washer 29 use to generate holding strength and melt together with resistance elastic tube 23 all three numeral 23, 28 and 29 is processed through vulcanization process for converting natural rubber or related polymers into more durable materials to hard rubber and by treating with pressure-sensitive adhesive.

After processing the harden rubber end tube is now flat and hard, the hard flat end of resistance elastic tube 23 is assembled by holding and clasp together with adjustment strap 34 and mating end strap 32 numeral 34 and 32 are stitched 33 together.

Joining all parts together numeral 23, 28, 29, 32, 34 is male and female Rivet 30 or equivalent binder screw having the same characteristics as a fastener. Assemble is tested rigorist using dynamic tension force.

FIG. 10 is an elevational collective view taken in the plane indicated by the line 10-10 in FIG. 5 illustrating of the structure a portion broken away to show the manner of attachment.

Referring to main mounting attachment belt 5 attached is mounting loop 21 and webbing belt 8 is sewn together by stitching 22 extending through numeral 5, 21 and 8 including flexible material 18 material such as nylon canvas and internally encased is foam sheet 16 a thick appropriate cushioning material such as closed-cell polyurethane sewn together at opposite ends in the usual manner using heavy nylon tread.

It should be noted mounting loop 21 doubles folds in bottom strengthening attachment belt 5 to withstand the force generated by exerciser.

Referring to attachment belt 5 it should be noted locking strap holder 17 is fixed and attached to attachment belt 5 and is the medium between adjustment strap 34 and strap holder 17 direction of arrows 31 shows strap looping sequence and direction. Assemble is tested rigorist using dynamic tension force.

Figure 11:
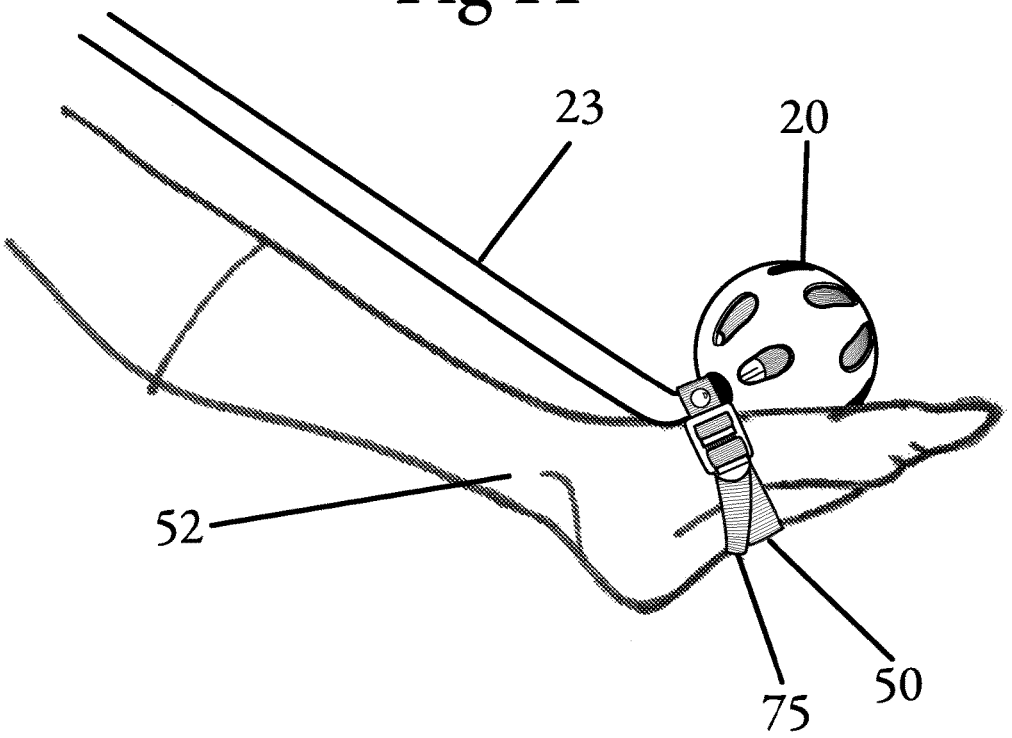
FIG. 11 is an enlarged perspective view of the portion of human foot attached to foot strap to hold and lock hollow ball end and resistance elastic tube illustrating a method of attachment to portion of the foot.

FIG. 11 illustration shows a foot strap 50 adapted to be worn about the foot of a person designated by individual foot 52 it should be noted that while only one foot strap 50 is illustrated, it is understood that the device be worn on both feet adjustable foot strap 75 loosens and tightens strap and locks in place hollow ball end 20 and resistance elastic tube 23.

Foot strap 50 must be strong while securing apparatus in place and feeling a natural fit when worn, yet strong and secure from coming off.

An analogy is a good fitting shoe, feeling a natural fit when worn but strong and secure from elements and conditions.

Foot strap 50 holds apparatus in place while exerting muscular movements on both legs using freely wide range of motion and angles on entire lower body extremities.

Figure 12:
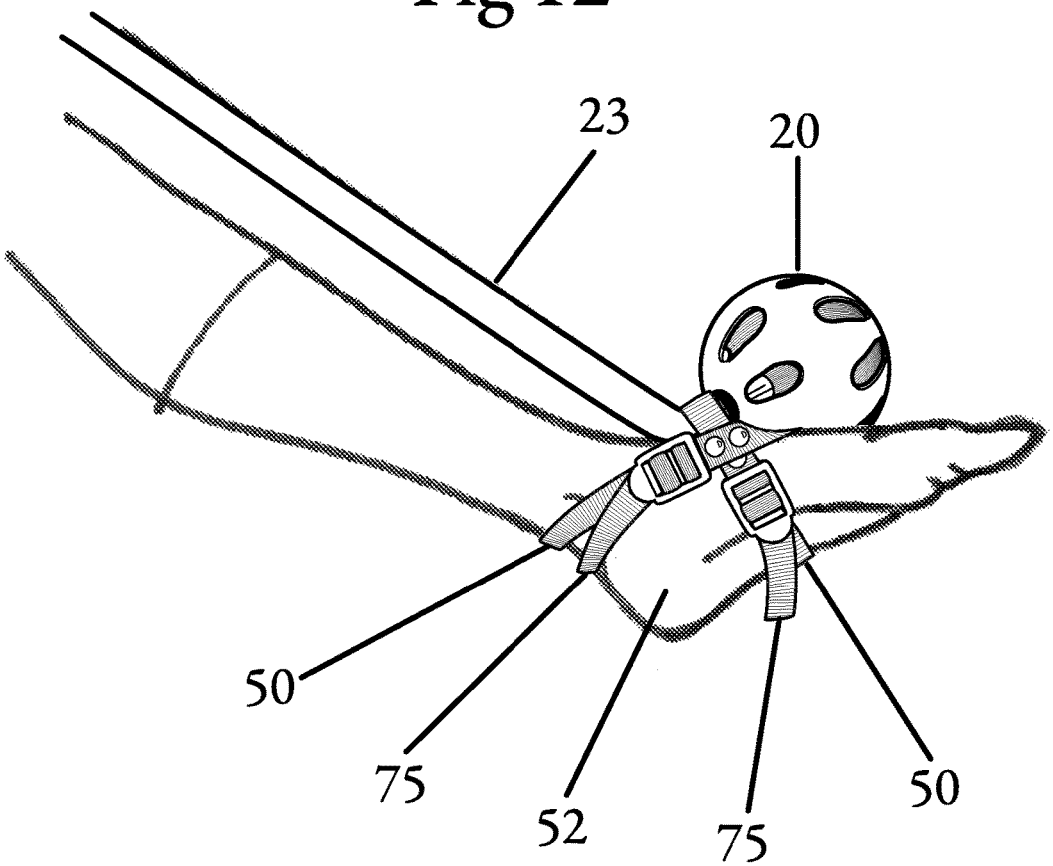
FIG. 12 is an enlarged perspective view of the portion of human foot, attached vertical foot strap to hold and lock hollow ball end and resistance elastic tube, adding an optional horizontal foot strap to hold and lock for additional security while being held in foot, illustrating method of attachment to portion of the foot.

FIG. 12 illustration shows two foot strap 50 worn for extreme sports that uses foot speed and abrupt movements or exercising and training with extreme leg angles illustration shows foot strap 50 worn on the vertical direction, foot strap 50 is don on top of foot and top of resistance elastic tube 23 designated by individual foot 52, as shown on FIG. 11.

A second foot strap 50 adapted to be worn horizontal, foot strap 50 is don on ankle and top of foot and under hollow ball end 20 illustration shows hollow ball end 20 and resistance elastic tube 23 locked in place and preventing from moving side to side or end to end.

Tightening and holding down both vertical and horizontal adjustable foot straps 75 insures foot strap 50 will hold apparatus in place while exerting extreme body motion force while training and exercising.

It should be noted that one foot strap 50 is sufficient for normal use, two foot strap 50 guarantees wellbeing.

An analogy of wellbeing is saving your computer program; saving your program a second time to external device guarantees wellbeing.

Extreme sports that uses foot speed and abrupt movements and extreme leg angles while exercising and training is; martial art, boxing, jumping rope, pilates and yoga, it should be noted; these is just a samples of usage of apparatus for extreme sports.

Figure 13B:
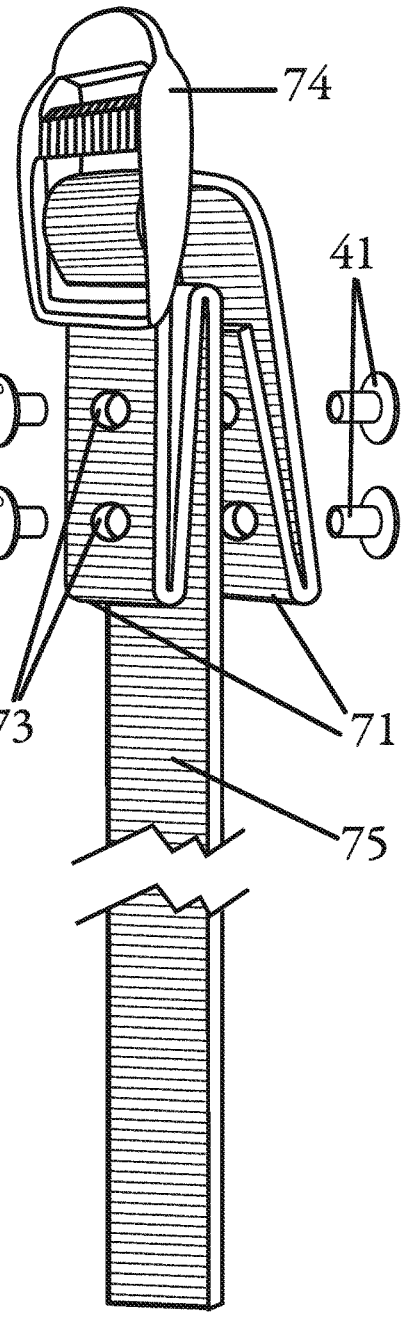
FIG. 13*b* is a perspective view illustrating the invention and construction of the device being broken away to illustrate the manner of order of attachment and revealing each individual part associated with apparatus, portions being broken away to reveal underlying formation of the structure.
Figure 13A:
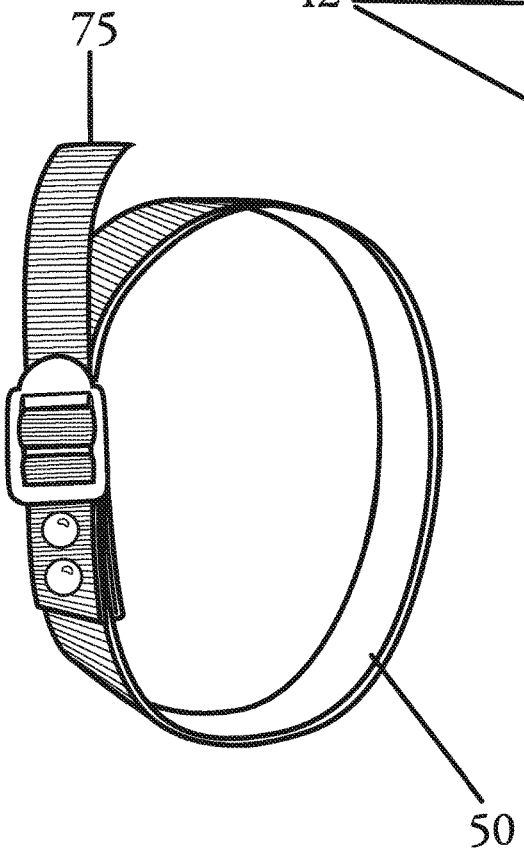
FIG. 13*a* is a perspective view illustrating the apparatus, showing foot strap for feet or sneaker, illustrating end portion of adjustment foot straps, connected to foot tension lock.

FIG. 13*a* illustration shows assembled foot strap 50 consist of adjustable foot strap 75 material commonly known as webbing and known for strength and non-elasticity but may be formed from any other suitable material that possesses like characteristics, webbing is made of synthetic fibers such as nylon, polypropylene or polyester.

Foot straps 50 is loosened and tighten with adjustable foot strap 75 insuring apparatus is secure preventing apparatus from coming off or breaking out when fasten to feet or sneakers.

FIG. 13*b* in terms of greater detail apparatus illustration shows foot strap 50 being broken away to illustrate the manner of order of attachment and revealing each individual part associated with apparatus portions reveal underlying formation of the structure.

Webbing is attached and looped through foot tension lock 74 plastic material consisting of synthetic or semi-synthetic organic compounds that is malleable and can be molded into solids or any alloy. The webbing is folded in a zigzag motion strap 71 folding similar to bellows of an accordion, winding and twisting to left and right, forming five sides of webbing.

Adjustable foot strap 75 is joined together with two locating thru-hole 73 on five parts folds of webbing assembled together numeral 71, 75 and 74, with two female rivet 42 and mating male rivet 41 material metal ally or same like characteristics, let it be known foot strap 50 can be fasten by sewn, bolted or bonded together.

Figure 14:
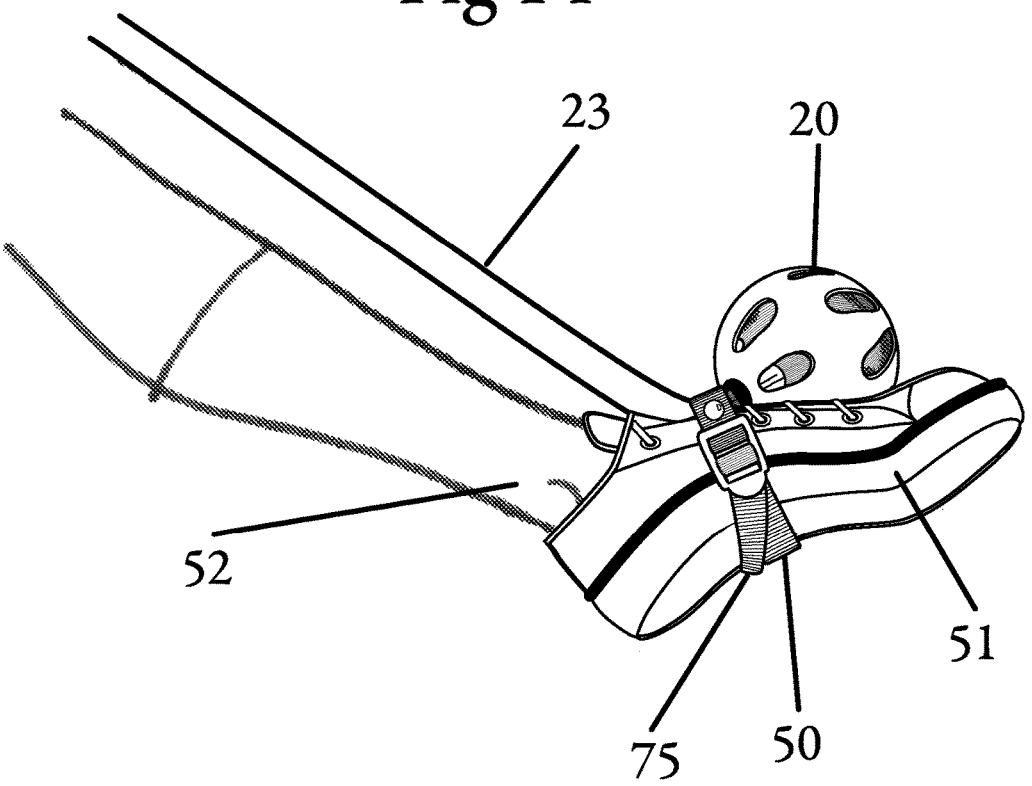
FIG. 14 is an perspective view of the a portion of human wearing sneaker, attached foot strap to hold and lock hollow ball end and resistance elastic tube, illustrating method of attachment to top portion of sneaker. Portable strength training and exercise apparatus is truly universal for almost every sport to train and strengthen muscles needed, usable both indoors or outdoors anywhere and anytime.

FIG. 14 it should be noted FIG. 14 is the same as FIG. 11 except for individual foot 52 wearing sneaker 51 also known as tennis shoe a perspective view illustrating the apparatus showing foot strap 50 don about the top of sneaker locks in place hollow ball end 20 and resistance elastic tube 23, adjustable foot strap 75 is loosened and tighten and locks strap in place to prevent hollow ball end 20 and resistance elastic tube 23 from coming off when fasten to foot strap 50 apparatus has unique holding strength to withstands acceleration force created by individuals while exercising wide range of motion and angles.

The disclosed portable strength training and exercise apparatus is unique and universal for training in almost every sport, targets and strengthen muscles with countless exercises routines to excel in fitness, sports training, recreation, rehab and therapy and includes walking exercises using apparatus both indoors or outdoors anywhere and anytime.

Let it be understood the portable strength training and exercise apparatus is compact and easily manufactured at low cost and which is easily stored when not in use. It is believed that through diligent use of this exercise apparatus the exercising individual may be enhanced over time to enable and enhance body strength and body toning and for a healthy life.

It will be apparent from the foregoing that, while particular forms of the disclosure have been illustrated and described, various modifications can be made without parting from the spirit and scope of the disclosure.

Furthermore, the various embodiments described above are provided by way of illustration only and should not be construed to limit the invention. For example, while described as a portable strength training and exercise apparatus, embodiments are not so limited. For example, the invention and the techniques and methods of attaching objects to elastic bands could be used on other equipment, such as medical devices or hunting equipment. Those skilled in the art will readily recognize various modifications and changes that may be made to the disclosed invention without following the example embodiments and applications illustrated and described herein.

I claim:

1. A portable strength training and exercise apparatus, comprising:

a) an attachment belt having opposite free ends adapted to encircle the waist when worn by an individual;

b) at least three locking strap holders mounted on the belt spaced from left, center and right whereby when said attachment belt is worn by said individual, said locking strap holders are substantially evenly distributed about the body of said individual;

c) at least one adjustment strap attached to at least one of said locking strap holders;

d) at least one hollow ball adapted to be secured to at least one resistance elastic tube;

e) said at least one resistance elastic tube attached to at least one of said locking strap holders and adapted to be of sufficient length to extend from the waist of said individual to a portion of the foot of said individual when stretched during exercise; and f) said at least one hollow ball adapted to be secured to said individual's foot with a foot strap.

2. The portable strength training and exercise apparatus of claim 1, further comprising at least one of said locking strap holders attached to at least one mounting loop with webbing sewn together with heavy stitching on at least one end of said attachment belt to withstand the force generated by said individual.

3. The portable strength training and exercise apparatus of claim 1, further comprising at least one solid ball glued inside at least one end of said at least one resistance elastic tube as an attachment means for attaching said hollow ball end to said at least one resistance elastic tube.

4. The portable strength training and exercise apparatus of claim 1, further comprising at least one resistance elastic tube end, a strap solid ball, and a mounting felt washer secured in place together by a vulcanizing process and by treating with pressure-sensitive adhesive applied to the said at least one resistance elastic tube end causing said at least one resistance elastic tube end to become flat and hard, facilitating the attachment of said at least one resistance elastic tube end to an attachment belt having opposite free ends adapted to encircle the waist when worn by an individual.

5. The portable strength training and exercise apparatus device according to claim 4, wherein said strap solid ball is inserted and placed inside of said resistance elastic tube.

6. The portable strength training and exercise apparatus according to claim 4, further comprising said at least one resistance elastic tube attached to at least one locking strap holder, wherein said at least one locking strap holder on said attachment belt is adjustable in the horizontal and/or vertical directions for sufficient tension for various forms of exercise for said individual.

7. The portable strength training and exercise apparatus according to claim 4, wherein an adjustable strap is attached between one of said locking strap holders and one resistance elastic tube.

8. A portable strength training and exercise apparatus, comprising:

a) an attachment belt having opposite free ends adapted to encircle the waist when worn by an individual;

b) at least three locking strap holders mounted on the belt spaced from left, center and right, whereby when said attachment belt is worn by said individual, said locking strap holders are substantially evenly distributed about the body of said individual;

c) at least one adjustment strap attached to at least one of said locking strap holders;

d) at least one hollow ball adapted to be grasped with one or two hands and adapted to be secured to at least one resistance elastic tube, which is configured to extend along the waist of said individual to a portion above the shoulder of said individual;

e) at least one resistance elastic tube end secured in place by a vulcanizing process applied to said at least one resistance elastic tube end causing said at least one resistance elastic tube end to become flat and hard, and facilitating the attachment of said at least one resistance elastic tube end to said attachment belt having opposite free ends adapted to encircle the waist when worn by said individual;

f) at least one solid ball glued inside at least one end of said at least one resistance elastic tube as an attachment means for attaching said hollow ball to said at least one resistance elastic tube; and g) at least one grommet to secure at least one end of said at least one resistance elastic tube in place to prevent said at least one resistance elastic tube from pulling out of said hollow ball during exercise and to keep said at least one resistance elastic tube from tearing or breaking out of said hollow ball.

9. The portable strength training and exercise apparatus according to claim 8, wherein said at least one resistance elastic tube is secured from tearing or breaking out of said hollow ball by an adhesive dam.

10. The portable strength training and exercise apparatus according to claim 8, wherein said attachment belt is constructed using foam sheet and webbing belt, encased in flexible material with quick disconnect buckles sewn together with heavy stitching.

11. The portable strength training and exercise apparatus according to claim 8, wherein said attachment belt is provided a stitched, mounting loop attached to at least one locking strap holder end portion with an adjustable strap that may be selectively adjusted.

* * * * *